US006037762A

United States Patent [19]

Koelling et al.

[11] Patent Number: 6,037,762

[45] Date of Patent: Mar. 14, 2000

[54] VOLTAGE DETECTOR HAVING IMPROVED CHARACTERISTICS

[75] Inventors: Jeffrey E. Koelling, Dallas; Yung-che Shih, Plano, both of Tex.

[73] Assignee: Texas Instruments Incorporated, Dallas, Tex.

[21] Appl. No.: 09/213,524

[22] Filed: Dec. 17, 1998

[51] Int. Cl.[7] ..... G05F 3/16

[52] U.S. Cl. ..... 323/313; 323/274; 323/284; 327/62

[58] Field of Search ..... 323/282, 284, 323/285, 313, 351, 274; 327/58, 62

[56] References Cited

U.S. PATENT DOCUMENTS

| | | | |
|---|---|---|---|
| 3,641,422 | 2/1972 | Farnsworth et al. | 323/224 |
| 4,714,877 | 12/1987 | Kong | 324/133 |
| 4,731,574 | 3/1988 | Melbert | 323/275 |
| 4,808,905 | 2/1989 | Chen et al. | 323/222 |
| 5,077,518 | 12/1991 | Han | 323/275 |
| 5,747,974 | 5/1998 | Jeon | 323/269 |
| 5,801,552 | 9/1998 | Moore | 327/62 |
| 5,814,980 | 9/1998 | Lewis | 323/311 |

*Primary Examiner*—Adolf Denske Berhane
*Attorney, Agent, or Firm*—Robby T. Holland; Carlton H. Hoel; Richard L. Donaldson

[57] ABSTRACT

The present invention includes a circuit for detecting voltage levels in an integrated circuit including a first reference voltage(324), a first differential amplifier(349) having an inverting input terminal connected to the first reference voltage, a non-inverting input terminal and an output terminal, a first transistor (356) having a control terminal connected to the output terminal of the first differential amplifier, having a first current handling terminal connected to a voltage supply terminal and having a second current handling terminal connected to the non-inverting input terminal of the first differential amplifier, a first load (358) device having a first terminal connected to the second current handling terminal of the first transistor and a second terminal, a second load device (360) having a first terminal connected to the second of the first load device and a second terminal connected to a second reference potential, a second differential amplifier (391) having an inverting input terminal, a non-inverting input terminal in connected to the first terminal of the second load device and having an output terminal, the output terminal providing voltage detection output signal, a second transistor (382) having a control terminal connected to the output terminal of the first differential amplifier, having a first current handling terminal connected to the voltage supply terminal and having a second current handling terminal connected to the inverting input terminal of the second differential amplifier, a third load device (386, 384) having a first terminal connected to the inverting input terminal of the second differential amplifier and having a second terminal connected to the point at which a voltage level is to be detected. This provides a highly stable voltage detection system.

36 Claims, 5 Drawing Sheets

VOLTAGE DETECTOR HAVING IMPROVED CHARACTERISTICS

BACKGROUND OF THE INVENTION

1. Field of the Invention

The present invention is related to the detection of voltage in integrated circuits. More specifically, the present invention is related to the detection of on-chip generated voltage levels and regulation of those on-chip-generated voltages.

2. Relevant Background

In a modern integrated circuit, there are many voltage levels required for proper operation. However, to simplify the input/output connection system of the integrated circuit (i.e., minimize the number of pins), customers have demanded very simple power supply requirements with one ground input and one power supply input pin. Integrated circuit manufacturers have responded by providing integrated circuits that generate on-chip voltages to satisfy performance requirements. These on-chip voltage generators use devices such as current pumps to boost the voltage or lower the voltage to the appropriate level. These voltage generators must be carefully regulated to provide the appropriate voltage on the integrated circuit.

FIG. 1 is a schematic diagram of a prior art voltage regulator for determining the voltage level of a voltage boosted above the power supply voltage, commonly referred to as $V_{pp}$. $V_{pp}$ is connected to the drain of P-channel transistor 10. The gate of P-channel transistor 10 is tied to the source of P-channel transistor 10. The source of P-channel transistor 10 is connected to the drain of P-channel transistor 12. The gate of transistor 12 is connected to a reference potential $V_{Ref}$. The source of transistor 12 is connected to the drain of P-channel transistor 14, which has its gate connected to a ground potential and its source connected to a ground potential. In this configuration, the voltage at node 16 is pulled to near ground unless the voltage on the source of transistor 12 is pulled to higher than one $V_t$ above $V_{Ref}$, in which case the voltage on node 16 will be pulled high.

A reference potential $V_{Ref2}$ is connected to the gate of N-type transistor 18. The output of node 16 is connected to N-type transistor 20. These transistors are connected in the format of a differential amplifier, which is switched on and off by voltages applied to the gates of transistors 22 and 24. P-type transistors 26 and 28 provide pull-up potential for the differential amplifier. The output of the differential amplifier is provided on the gates of P-channel transistor 30 and N-channel transistor 31. Transistors 30 and 31 provide a complimentary inverter, which is pulled up by P-type transistors 34 and 36 and pulled down by N-channel transistors 38 and 40. Transistors 22, 38, and 34 are narrow, low-current transistors. Transistors 24, 36, and 40 are wide, high-current driving transistors. On the pull-up side of the inverter including transistors 30 and 31, transistor 36 provides a strong pull-up and transistor 34 provides a weak pull-up. When the output of the inverter pair transistor 30 and 31 is high, it indicates that the voltage on the gate of transistor 20 is a lower voltage than $V_{Ref2}$ provided on the gate of transistor 18. This indicates that pumping is required to bring $V_{pp}$ to its proper voltage level.

The high voltage thus provided on the input of inverter 42 is inverted to a low output, which causes NOR gate 44 to provide a high output which is inverted by inverter 46 to provide a low output. This low output causes transistor 36 to remain on providing a high pull-up current source. The output of inverter 46 is inverted by inverter 48 to provide a high voltage, which causes transistor 34 to be off. Because transistor 36 is capable of providing higher drive current, this system provides a bias in the circuit to provide an "on" signal and thus to provide pumping for the generators generating $V_{pp}$. In a similar manner, the Enable signal provided to the gates of transistors 24 and 40 caused transistors 24 and 40 to provide stronger pull-down and thus faster operation when the enable signal is provided.

The input $V_{pump}$ provides an override to the circuit under various conditions indicated by high utilization of the integrated circuit. When $V_{pump}$ is high the output of inverter 50 is low which causes the output of NOR gate 44 to be high regardless of the input provided by inverter 42.

The threshold voltages of transistors 10 and 12 determine the triggering point of the voltage detector of FIG. 1. Threshold voltage varies with process variations in the fabrication of an integrated circuit containing the circuit of FIG. 1 and with the temperature of operation of the circuit. Thus the triggering point cannot be precisely set. Therefore, the prior art circuit of FIG. 1 does not have the stability in the face of process variations and temperature variations necessary for today's high density, and thus highly sensitive, integrated circuitry.

FIG. 2 is a schematic diagram of another prior art $V_{pp}$ detector. $V_{pp}$ is provided to the source of P-channel transistor 110. The gate of transistor 110 is connected to a reference voltage $V_{Ref}$. The drain of transistor 110 is connected to the source of P-channel transistor 1 12. The gate of transistor 1 12 is connected to a detection enable signal. Detection is enabled by the Enable signal going low, thus turning on transistor 112. Also, the Enable signal is provided to the gate of N-channel transistor 114, which is thus turned off. When the Enable signal is high, thus indicating that the detection is disabled, transistor 114 is on and the gate of transistor 116 is clamped to ground.

When the enable signal is low, transistor 114 is off and the voltage level on node 115 is determined by the voltage level of $V_{pp}$. As $V_{pp}$ rises above one $V_t$ above $V_{Ref}$, transistor 110 is turned on and node 115 is pulled high. A high voltage on node 115 causes transistor 116 to turn on. Transistor 116 is placed in series with pull-up transistor 120 which is a P-type transistor having its gate connected to ground and is source connected to Power supply 2. Transistor 122 is a pull-down transistor having its source connected to ground and its gate connected to Power supply 2. These two transistors are designed to have relatively high resistance and thus provide current pull-up and pull-down sources. Thus, the voltage at node 124 is determined solely by the state of transistor 116. When transistor 116 is on, the voltage point at node 124 is pulled low thus causing inverter 126 to have a high output and inverter 128 to have a low output. The voltage changes are damped by transistor 130, which is connected with its gate to the input of inverter 126 and both its source and drain to ground. This provides a capacitive function, which provides a time delay for the input at node 124. Inverters 126 and 128 feed step-down latch 132 which provides an output to the input of inverter 134 which is non-inverted from the input of inverter 126. The output of inverter 134 is inverted by inverter 136, thus providing a fully latched and buffered output of the circuit.

The voltage level detected in the circuit of FIG. 2 is highly dependent upon the threshold voltage of transistor 110. This characteristic is highly dependent upon process variations and temperature variations. Thus, the detector of FIG. 2 provides an unacceptable process variation for modern highly integrated circuits.

FIG. 3 is a prior art diagram of a $V_{bb}$ or substrate voltage detector. It is common in the industry to provide a substrate voltage lower than the lowest supplied voltage. Providing a high Enable signal, which turns off transistors 210 and 212, enables the detector of FIG. 3. The gate of transistor 218 is connected to ground. The gate of N-channel transistor 222 is also connected to ground. Transistors 224 and 226 have their gates connected to their drains, thus providing a two $V_t$ voltage drop from $V_{bb}$ to the source of transistor 222. When the source of transistor 222 is pulled one $V_t$ below ground the desired level by $V_{bb}$ going below the desired level, transistor 222 is on, and the gate of transistor of 228 is pulled to ground. Thus, transistor 228 is off. This low level also passes through transistor 218 to the gate of transistor 230, which is a P-channel transistor. Thus, P-channel transistor 230 is on.

When $V_{bb}$ rises to the level that transistor 228 is on, the input to inverter 250 is pulled to low and thus the output of inverter 250 is high. Transistors 230, 248, 228 and 246 form a NAND gate. A NAND gate with it's output NOTed is the functional equivalent of an OR gate. Thus, this NAND gate coupled with inverter 250 provide an OR gate. The Enable bar signal is low if the circuit of FIG. 3 is in operation, thus the output of inverter 211 is high. This combined with the high output of inverter 250 causes NAND gate 252 to provide a low output, signaling that the $V_{bb}$ pumps should pump to lower the $V_{bb}$ voltage level.

To provide a hysteresis effect, the circuit of FIG. 3 includes a double detection scheme. The second detector is provided when the enable bar signal turns on transistor 232. Transistor 212 has its gate connected to the source of transistor 210, thus providing the voltage drops from $V_{dd}$ established by transistors 210, 214, and 216. $V_{bb}$ is connected to the source of N-channel transistor 234 whose gate and drain are connected to the source of N-channel transistor 236. Thus, the drain of transistor 236 is two threshold voltage drops above $V_{bb}$. Transistors 236 and 234 are doped to provide higher threshold voltages than those of transistors 224 and 226. When the level of $V_{bb}$ goes below 3 threshold voltage drops, the gate of transistor 238 which is tied to ground is 1 threshold voltage higher than the drain of transistor 238. When $V_{bb}$ drops below this voltage (which is lower than the turn on point for transistor 222 because of the higher threshold voltages of transistors 236 and 234), transistor 240 is turned on and transistor 242 is turned off. Transistors 240, 242, 254 and 256 form a NOR gate with one input being the output of inverter 250 and the other being the level of $V_{bb}$ as determined by transistors 234, 236 and 238.

Because the output of inverter 250 is triggered to a high output by a higher (less negative) voltage than the voltage at which transistor 240 is turned off and transistor 242 turned on (because of the larger threshold voltages of transistors 234 and 236), transistor 242 will always be on when the output of inverter 250 goes high. Thus the input of inverter 244 is pulled low causing the voltage applied to the gates of transistors 246 and 248 to go high. This provides a latching effect because this causes inverter 250 to provide a high output regardless of the state of transistors 228 and 230. Once this latching effect has occurred, the level detection provided by transistors 234, 236 and 238 is in control. Only when $V_{bb}$ goes low enough (negative enough) to cause transistor 238 to turn on will the "latch" change states.

In certain circumstances, the substrate pump must be shut off under all circumstances, regardless of the voltage level detected by the voltage level detectors. In these circumstances Enable bar is brought high causing the $V_{bb}$ stop output signal provided by NAND gate 252 to be high regardless of the input signals provided by inverter 250.

As can be readily ascertained from the operation of the circuit of FIG. 3, this circuit is highly dependent on the threshold voltages of transistors 222, 224, 226, 236, 234, and 238. These behavioral characteristics are highly dependent upon process variations and thus are not acceptable for the highly sensitive circuitry of today's high density integrated circuits.

BRIEF DESCRIPTION OF THE INVENTION

SUMMARY OF THE INVENTION

The described embodiment of the present invention include a circuit for detecting voltage levels in an integrated circuit including a first reference voltage, a first differential amplifier having an inverting input terminal connected to the first reference voltage, a non-inverting input terminal and an output terminal, a first transistor having a control terminal connected to the output terminal of the first differential amplifier, having a first current handling terminal connected to a voltage supply terminal and having a second current handling terminal connected to the non-inverting input terminal of the first differential amplifier, a first load device having a first terminal connected to the second current handling terminal of the first transistor and a second terminal, a second load device having a first terminal connected to the second of the first load device and a second terminal connected to a second reference potential, a second differential amplifier having an inverting input terminal, a non-inverting input terminal connected to the first terminal of the second load device and having an output terminal, the output terminal providing voltage detection output signal, a second transistor having a control terminal connected to the output terminal of the first differential amplifier, having a first current handling terminal connected to the voltage supply terminal and having a second current handling terminal connected to the inverting input terminal of the second differential amplifier, a third load device having a first terminal connected to the inverting input terminal of the second differential amplifier and having a second terminal connected to the point at which a voltage level is to be detected. This provides a highly stable voltage detection system.

DETAILED DESCRIPTION OF THE PREFERRED EMBODIMENTS

Figure 1:
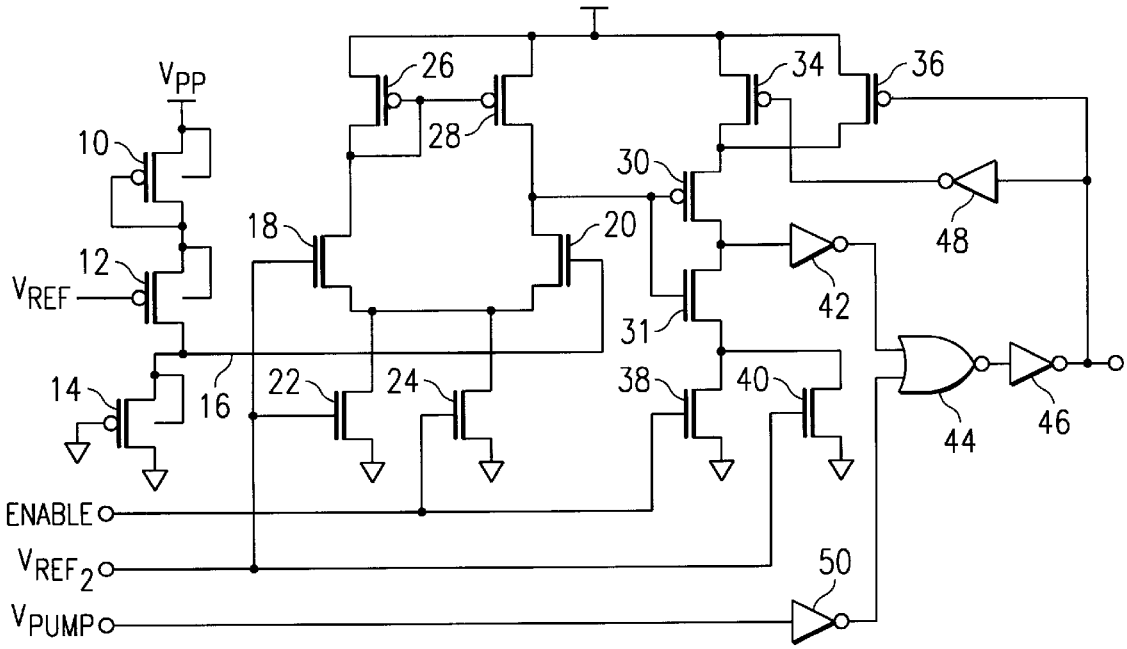
FIG. 1 (PRIOR ART)
FIGS. 1 through 3 are schematic diagrams of prior art voltage level detectors.
Figure 2:
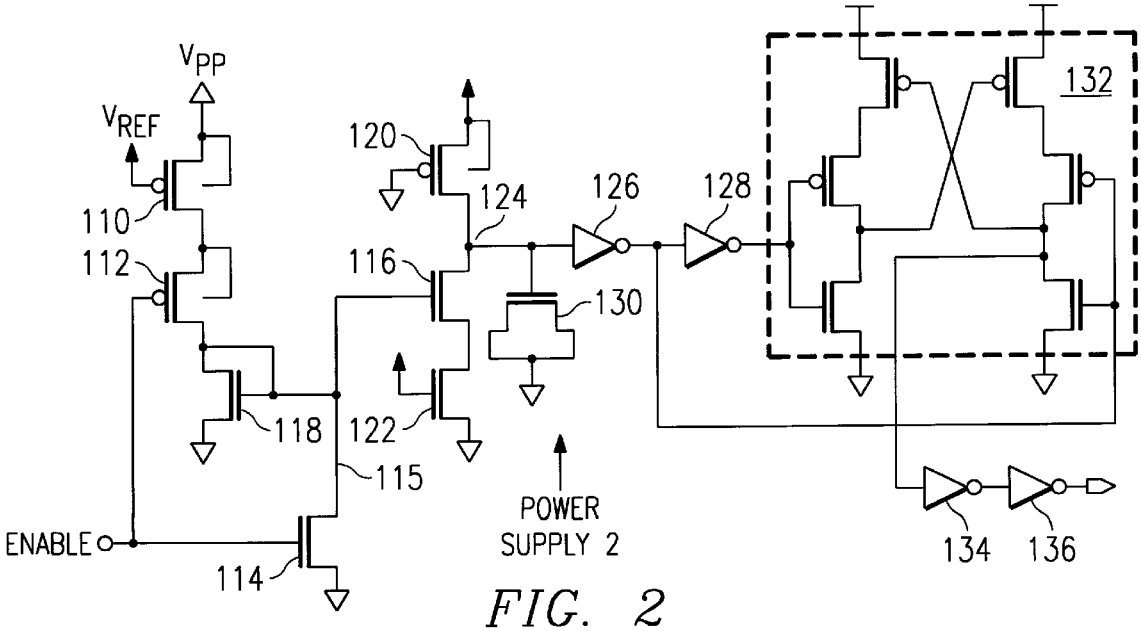
FIG. 2 (PRIOR ART)
Figure 3:
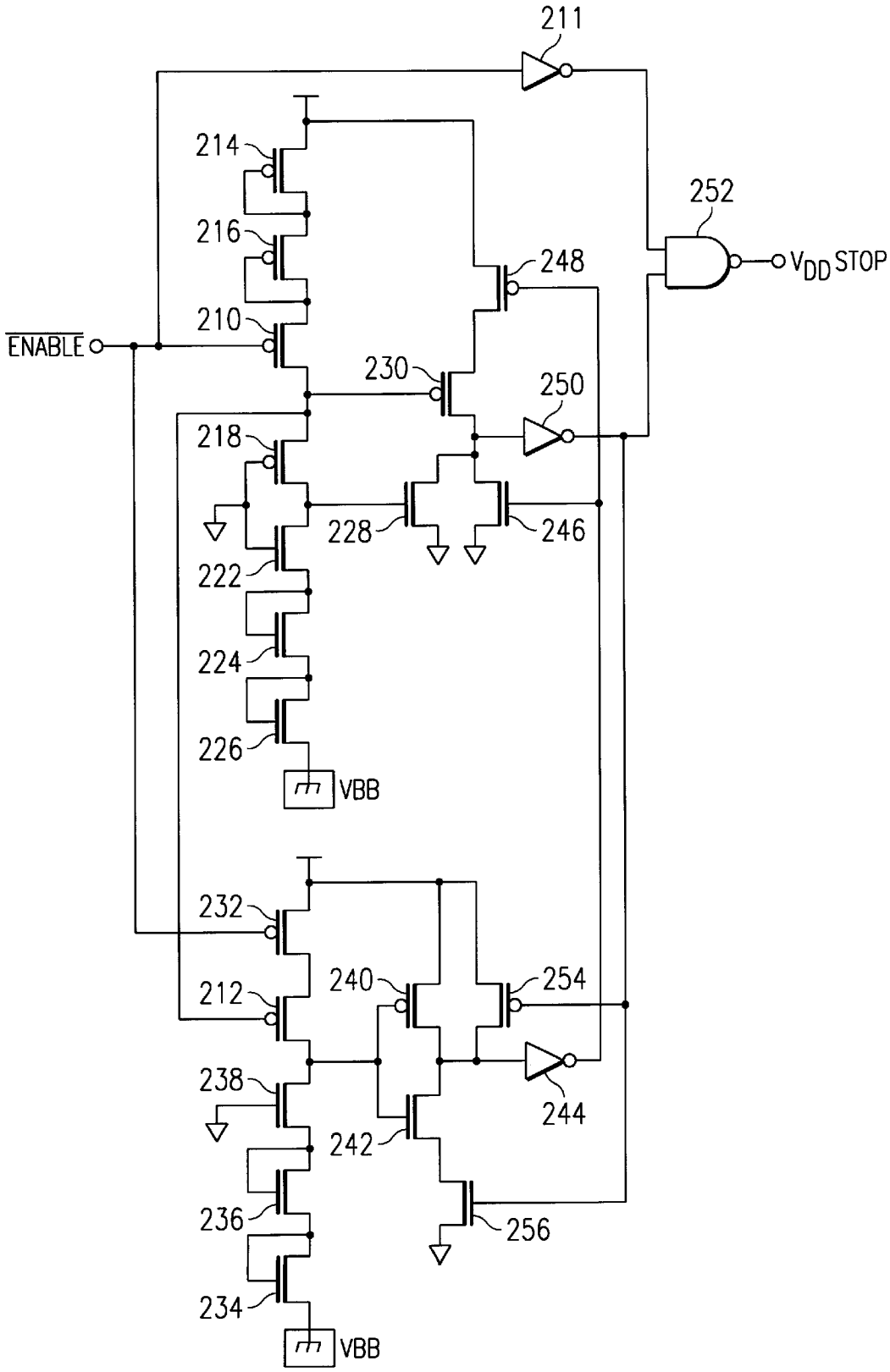
FIG. 3 (PRIOR ART)
Figure 4:
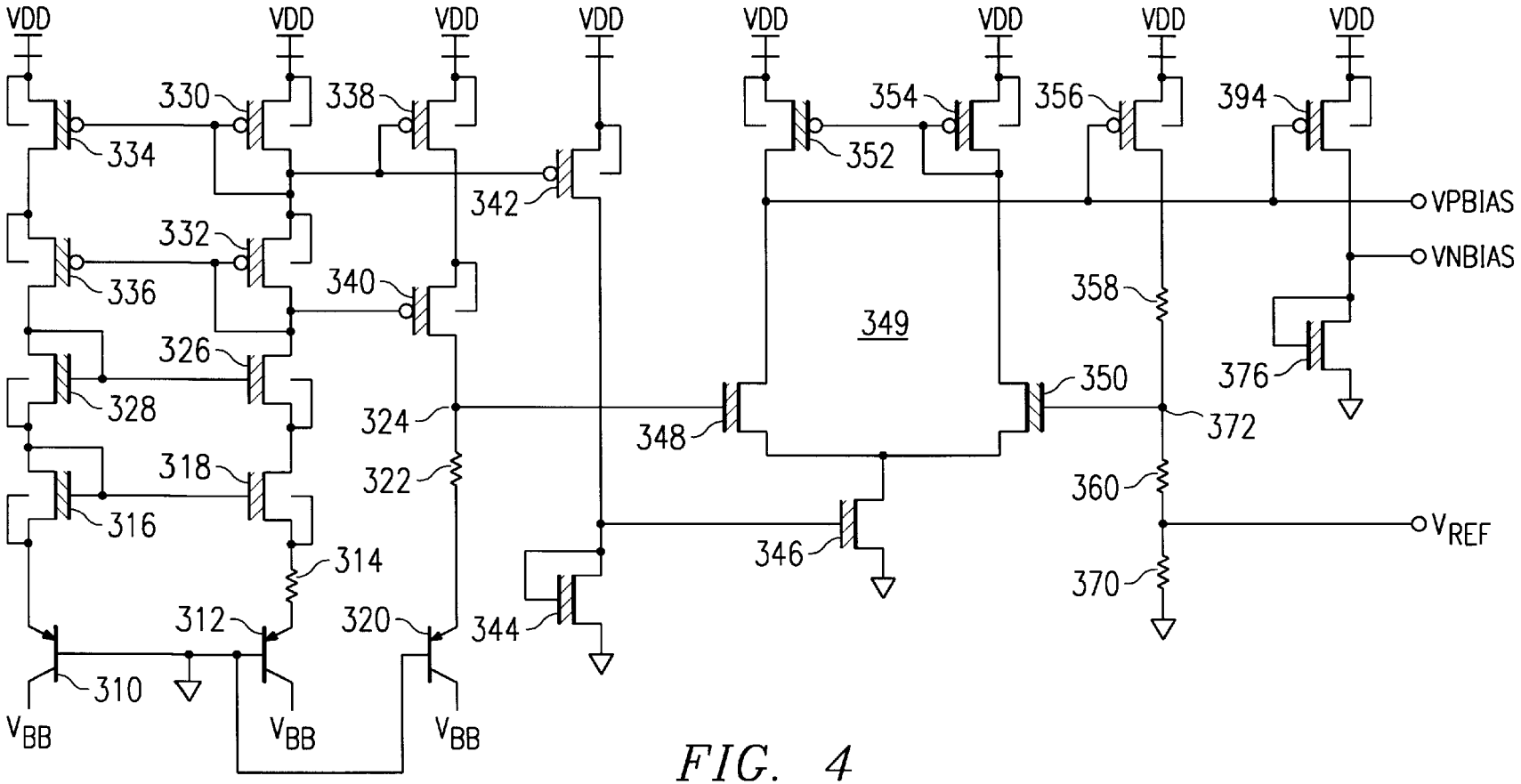
FIG. 4 is a schematic diagram of a portion of one embodiment of the present invention.

FIG. 4 is a schematic diagram of one embodiment of the present invention. FIG. 4 includes a band gap current level setting mechanism provided by PNP transistors 310 and 312, resistor 314 and N-channel transistors 316 and 318. Transistor 312 is selected to have a much higher current carrying capacity than transistor 310 for the same threshold voltage level. The collectors of transistor 310 and 312 are connected to the substrate $V_{bb}$ potential. The $V_{BE}$ voltages of transistors 310 and 312 set the current through transistors 310 and 312. Kirchhoff's Law says that the sum of the voltages around a closed path equal zero. Thus the $V_{BE}$ of transistors 310 and 312 plus the voltage drop across resistor 314 plus the $V_{GS}$ of transistors 318 and 316 must equal 0. Also, there are specific relationships between the $V_{BE}$ of transistor 310, the $V_{GS}$ of transistor 316 and the current through these transistors. Similarly, there are specific relationships between the $V_{BE}$ of transistor 312, the voltage drop across resistor 314 and the $V_{GS}$ of transistor 316 and the current through these transistors and resistor. Solving these equations provides a singular solution. Thus the band gap circuit provides highly stable current through transistors 310 and 312.

The highly stable current through transistor 312 also passes through transistors 330 and 332. This current is mirrored to transistors 338 and 340. The mirrored current provides a voltage across resistor 322, which sets the voltage at node 324 along with the $V_{BE}$ drop of transistor 320.

The voltage point at 324 is highly stable because it is dependent upon the relative resistivity levels of resistors 314 and 322. Because process variations will affect resistors 314 and 322 in the same manner, the voltage level set at node 324 is highly stable. For example, if the resistance of 314 is lowered, the current through transistor 312 is higher and the current mirrored to transistors 338 and 340 is higher. However, because the resistance of resistor 322 varies with the same process variations of resistor 314, its resistance value will be lowered. Thus, the higher current through transistors 338 and 340 will be offset by the lower resistance value of transistor 322.

The current mirrored to transistor 342 passes through transistor 344. This current is mirrored to transistor 346, which drives the differential amplifier 349 formed by transistors 348 and 350. Transistor 348 takes as its input to its gate the highly stable voltage level set at node 324. The differential amplifier pair formed by transistors 348 and 350 is provided pull-up current by transistors 352 and 354. The current flowing through resistors 348, 360 and 370 set the input voltage to the gate of transistor 350. The current through these resistors is set by transistor 356. If the voltage on the gate of 350 rises above that of the gate of 348, current through transistor 346 will be routed through transistor 350 thus causing the gate of transistor 356 to be pulled higher through the current supplied by transistor 352. This causes the voltage drop across resistors 360 and 370 to be lowered until the voltage of node 372 is precisely that provided on node 324. Thus, the differential amplifier provided by transistors 348 and 350 isolate node 324 from node 372 while providing precisely the equivalent voltage. This isolation prevents activity connected to $V_{Ref}$ provided by the voltage drop across 370 from affecting the precise voltage established by node 324. Also, process and temperature variations affecting differential amplifier 349 are precisely offset by the same variations affecting differential amplifier 391 of FIG. 5 or differential amplifier 421 of FIG. 6, as explained below.

In addition, the gate voltage level which causes the appropriate current to flow through transistor 356 is provided to the gate of transistor 374 which causes an approximately similar current to flow through transistor 374 and bias transistor 376. The output from the gates of transistor 374 provides a VPBIAS for biasing P-type pull-up transistors and the voltage at the gate of transistor 376 provides a VNBIAS for biasing pull-down transistors in the circuits of FIGS. 5 and 6.

Figure 5:
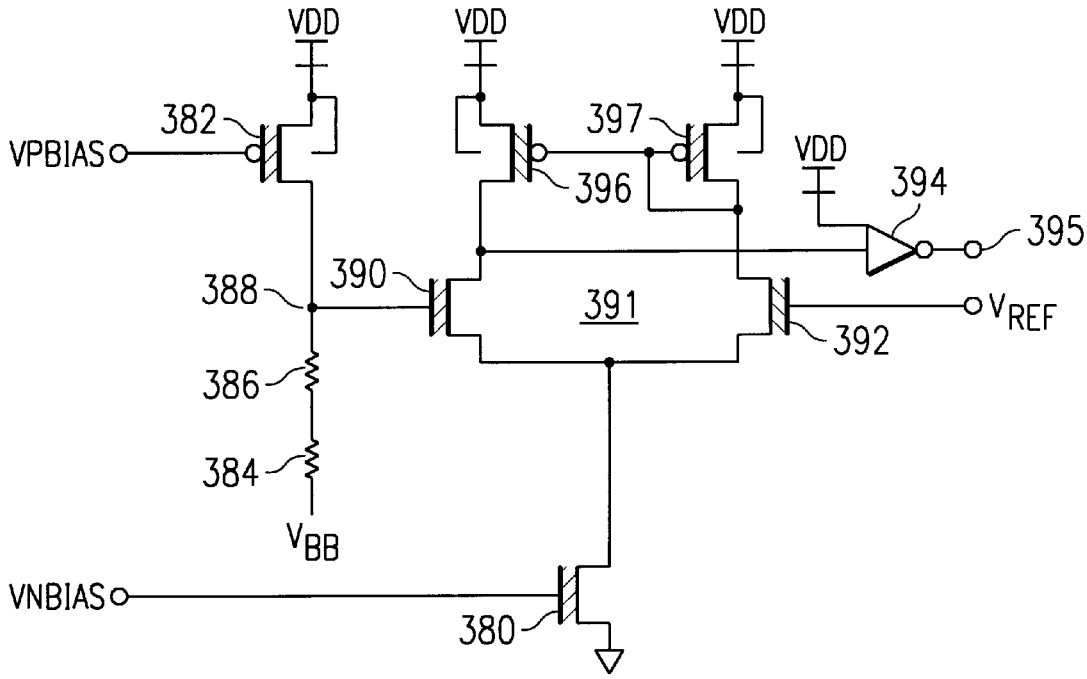
FIG. 5 is a partial schematic diagram of the $V_{bb}$ detector portion of the embodiment described in conjunction with FIG. 4.

FIG. 5 is a schematic diagram continuing one embodiment of the present invention which includes a detector for detecting the voltage level of $V_{bb}$. VNBIAS and VPBIAS from FIG. 4 are provided to the gates of transistors 380 and 382 respectively. VNBIAS and VPBIAS provide bias to these transistors so that they mirror the current carried in transistors 374 and 376 of FIG. 4. $V_{bb}$ is connected to resistors 384 and 386. The resistance between $V_{bb}$ and node 388 is broken into two resistors for ease of manufacturing (Is this the real reason?). Because the current level through VPBIAS is set at a fixed level, the voltage at node 388 will be a fixed level above $V_{bb}$ due to the voltage drop across resistors 386 and 384. This is because the voltage drop is the product of the fixed current through resistors 384 and 386 times their fixed series resistance. The process variations, which affect resistor 370 (FIG. 4) and resistors 386 and 384, will provide approximately the same variations due to temperature or other process variations. Therefore, these process variations will tend to cancel out in the operation of this voltage detector.

The voltage at node 388 is fed to the gate of transistor 390. $V_{Ref}$ is fed to the gate connected to the gate of transistor 392. Transistors 390 and 392 provide a differential amplifier such that when the voltage level on node 388 goes below the voltage level on node 392, transistor 390 begins to turn off, allowing the voltage applied to inverter 394 to be pulled up by pull-up transistor 396. A high voltage causes the output of inverter 394 to go to 0 indicating that $V_{bb}$ has been pumped to low and the $V_{bb}$ pump should turn off. If the voltage at node 388 goes too high, the voltage at the input of inverter 394 is pulled low via transistor 390 causing the opposite effect, which will cause the $V_{bb}$ pump to turn on.

Figure 6:
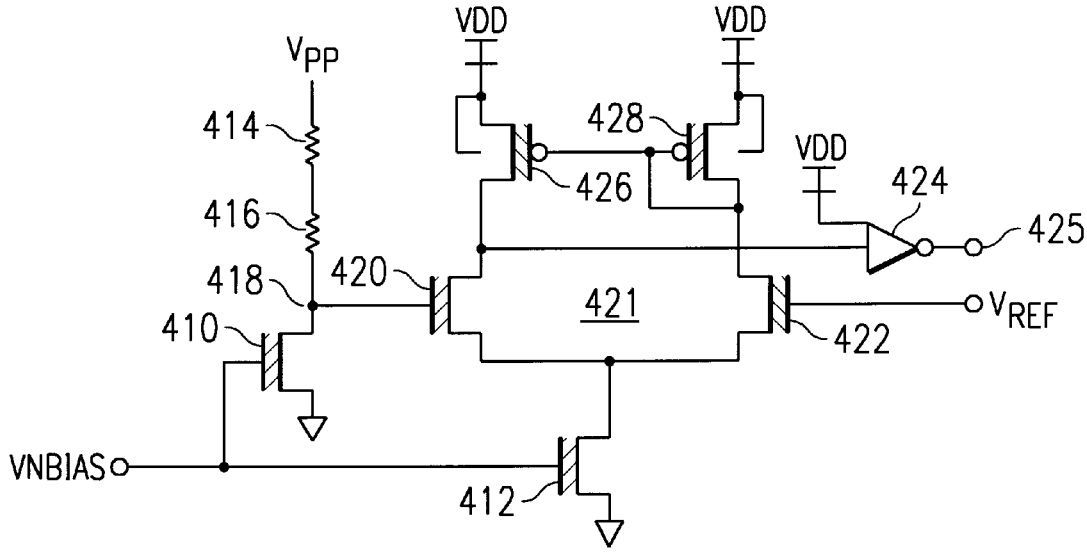
FIG. 6 is a schematic diagram of the $V_{pp}$ detector portion of one embodiment of the present invention provided in conjunction with the schematic diagram of FIG. 4.

FIG. 6 is the compliment of the present embodiment which allows the detection of $V_{pp}$ using the same reference voltages provided from the circuit of FIG. 4. VNBIAS from FIG. 4 is fed to the gates of transistors 410 and 412. $V_{pp}$ is connected to resistors 414 and 416 which cause a voltage drop from $V_{pp}$ to node 418 due to the current flowing through transistor 410. The voltage at node 418 is provided to the gate of transistor 420 and $V_{Ref}$ from FIG. 4 is provided to the gate of transistor 422. When $V_{pp}$ rises above the desired level, as indicated by the voltage at node 418, transistor 420 pulls more current which causes the input of inverter 424 to go low. Thus the output of inverter 424 goes high indicating an over-voltage condition and that voltage pump providing $V_{pp}$ should be stopped. When the voltage at node 418 goes below voltage reference, indicating that $V_{pp}$ is too low, transistor 420 pulls less strongly and the input of 424 is allowed to be pulled up via transistor 426. Transistor 428 provides a load function for the other input of the differential amplifier.

The self-correcting mechanism of the device of FIG. 6 is somewhat more complicated than the self-correcting mechanism of the device of FIG. 5. If a process variation or temperature variation has caused the resistance values of transistors 414 and 416 to go down, the resistance of resistors 348, 360, and 370 will have been lowered because the same process and temperature variations affect them similarly. Thus, with the same fixed voltage on node 372 of FIG. 4, a larger current will be flowing through transistor 356. This larger current is mirrored to transistor 374 (FIG. 4), which is in turn mirrored from transistor 376 (FIG. 4) to transistor 410 (FIG. 6). The higher current through transistor 410 offsets the lower resistance value of resistors 414 and 416, thus bringing the voltage drop across resistors 414 and 416 to the proper value and indicating the correct voltage level at the gate of transistor 420.

Figure 7:
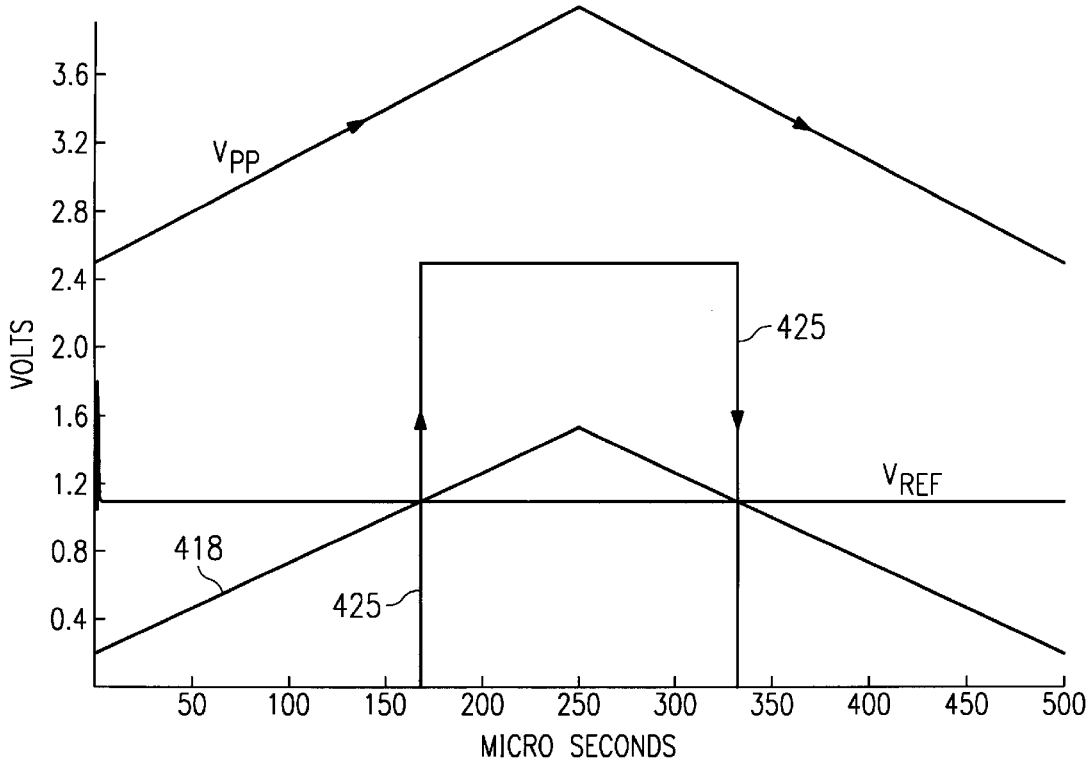
FIG. 7 is a signal chart showing the operation of the circuit of FIG. 5.

FIG. 7 is a voltage diagram where $V_{bb}$ was varied from 0 to −2 volts below ground. This shows that as $V_{bb}$ was varied, the voltage at node 388 varied in a linear fashion along with this voltage. This also shows that as voltage at node 388 passed through $V_{Ref}$, the output at node 395 went from a 1 value to a 0 value and vice versa as the voltage at node 388 passed once again above $V_{Ref}$. This demonstrates the operation of the circuit of FIG. 5.

Figure 8:
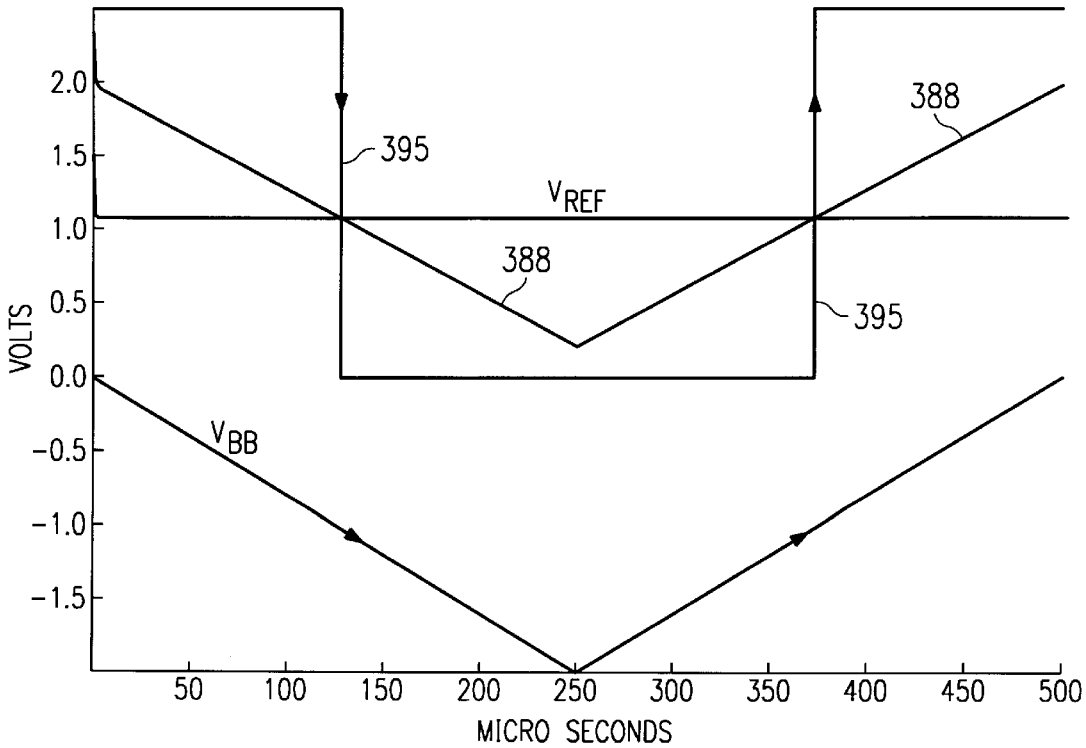
FIG. 8 is a signal chart showing the operation of the circuit of FIG. 6.

Similarly, FIG. 8 shows the operation of the voltage detection mechanism shown in FIG. 6. In this experiment $V_{pp}$ was allowed to rise from 2.4 volts to 3.8 volts and back to 2.4 volts. 2.4 volts is the approximate supply voltage of this integrated circuit. As can be shown from the diagram the voltage at node 418 tracked linearly the voltage on $V_{pp}$ and when the voltage on 418 passed through $V_{Ref}$, the output from inverter 424 at 425 went from a 0 voltage state to a 2.4 voltage state indicating a 1. Also, as the voltage on node 418 passed through $V_{Ref}$ to below $V_{Ref}$, the output at node 425 went from a 1 voltage to a 0 voltage, thus providing accurate voltage detection of the voltage of $V_{pp}$.

Of importance, the described embodiments of the present invention include differential amplifiers where the voltage reference input is applied to the same functional input of the two differential amplifiers in the circuit. For example, node 324 of FIG. 4 is connected to the inverting input of differential amplifier 349 and node 388 of FIG. 5 is connected to the inverting input of differential amplifier 391. Also, $V_{Ref}$ is transferred via the non-inverting inputs of differential amplifiers 349 and 391. With this configuration, those process variations or temperature effects that alter the characteristics of one differential amplifier in the system are offset by the same variations or effects on the other amplifier. This provides a highly stable circuit suitable for the demand of modern ultra-large scale integrated circuits.

Although the present invention has been described using specific embodiments, other embodiments of the present invention will become clear to those skilled in the art. For example, although the disclosed embodiment of the present invention shows detectors for detecting $V_{pp}$ and $V_{bb}$, voltage detection is a widely used technique and may be used to detect any voltage provided in an appropriate circuit. The present invention is limited only by the claims appended hereto.

I claim:

1. A circuit for detecting voltage levels in an integrated circuit comprising, A first reference voltage;

A first differential amplifier having an inverting input terminal connected to said first reference voltage, a non-inverting input terminal and an output terminal;

A first transistor having a control terminal connected to said output terminal of said first differential amplifier, having a first current handling terminal connected to a voltage supply terminal and having a second current handling terminal connected to said non-inverting input terminal of said first differential amplifier;

A first load device having a first terminal connected to said second current handling terminal of said first transistor and a second terminal;

A second load device having a first terminal connected to said second of said first load device and a second terminal connected to a second reference potential;

A second differential amplifier having an inverting input terminal, a non-inverting input terminal connected to said first terminal of said second load device and having an output terminal, said output terminal providing voltage detection output signal;

A second transistor having a control terminal connected to said output terminal of said first differential amplifier, having a first current handling terminal connected to said voltage supply terminal and having a second current handling terminal connected to said inverting input terminal of said second differential amplifier; and A third load device having a first terminal connected to said inverting input terminal of said second differential amplifier and having a second terminal connected to the point at which a voltage level is to be detected.

2. A circuit as in claim 1 wherein said first load device is a resistor.

3. A circuit as in claim 1 wherein said second load device is a resistor.

4. A circuit as in claim 1 wherein said third load device is a resistor.

5. A circuit as in claim 1 wherein said first transistor is a field effect transistor.

6. A circuit as in claim 1 wherein said second transistor is a field effect transistor.

7. A circuit as in claim 1 wherein said first reference voltage is supplied by a circuit comprising:

A band gap current generator;

A current mirror connected to said band gap current generator, said current mirror providing a current proportional to the current generated in said band gap current generator on a current output terminal; and A load device having a first terminal connected to said current output terminal and a second terminal connected to a third reference potential.

8. A circuit as in claim 1 wherein said third reference potential is provided by connecting the base of a bipolar transistor to said second reference voltage and emitter of said bipolar transistor to said second terminal of said load device.

9. A circuit as in claim 1 wherein said load device is a resistor.

10. A circuit as in claim 1 wherein said first load device is a resistor.

11. A circuit as in claim 1 wherein said second load device is a resistor.

12. A circuit as in claim 1 wherein said third load device is a resistor.

13. A circuit as in claim 1 wherein said first transistor is a field effect transistor.

14. A circuit as in claim 1 wherein said second transistor is a field effect transistor.

15. A circuit as in claim 1 wherein said first reference voltage is supplied by a circuit comprising:

A band gap current generator;

A current mirror connected to said band gap current generator, said current mirror providing a current proportional to the current generated in said band gap current generator on a current output terminal; and A load device having a first terminal connected to said current output terminal and a second terminal connected to a third reference potential.

16. A circuit as in claim 1 wherein said third reference potential is provided by connecting the base of a bipolar transistor to said second reference voltage and emitter of said bipolar transistor to said second terminal of said load device.

17. A circuit as in claim 1 wherein said load device is a resistor.

18. A circuit as in claim 1 wherein said first load device is a resistor.

19. A circuit as in claim 1 wherein said second load device is a resistor.

20. A circuit as in claim 1 wherein said third load device is a resistor.

21. A circuit as in claim 1 wherein said first transistor is a field effect transistor.

22. A circuit as in claim 1 wherein said second transistor is a field effect transistor.

23. A circuit as in claim 1 wherein said first reference voltage is supplied by a circuit comprising:

A band gap current generator;

A current mirror connected to said band gap current generator, said current mirror providing a current proportional to the current generated in said band gap current generator on a current output terminal; and A load device having a first terminal connected to said current output terminal and a second terminal connected to a third reference potential.

24. A circuit as in claim 1 wherein said third reference potential is provided by connecting the base of a bipolar transistor to said second reference voltage and emitter of said bipolar transistor to said second terminal of said load device.

25. A circuit as in claim 1 wherein said load device is a resistor.

26. A circuit as in claim 1 wherein said first load device is a resistor.

27. A circuit as in claim 1 wherein said second load device is a resistor.

28. A circuit as in claim 1 wherein said third load device is a resistor.

29. A circuit as in claim 1 wherein said first transistor is a field effect transistor.

30. A circuit as in claim 1 wherein said second transistor is a field effect transistor.

31. A circuit as in claim 1 wherein said first reference voltage is supplied by a circuit comprising:

A band gap current generator;

A current mirror connected to said band gap current generator, said current mirror providing a current proportional to the current generated in said band gap current generator on a current output terminal; and A load device having a first terminal connected to said current output terminal and a second terminal connected to a third reference potential.

32. A circuit as in claim 1 wherein said third reference potential is provided by connecting the base of a bipolar transistor to said second reference voltage and emitter of said bipolar transistor to said second terminal of said load device.

33. A circuit as in claim 1 wherein said load device is a resistor.

34. A circuit for detecting voltage levels in an integrated circuit comprising:

A first reference voltage;

A first differential amplifier having an inverting input terminal connected to said first reference voltage, a non-inverting input terminal and an output terminal;

A first transistor having a control terminal connected to said output terminal of said first differential amplifier, having a first current handling terminal connected to a voltage supply terminal and having a second current handling terminal connected to said non-inverting input terminal of said first differential amplifier;

A first load device having a first terminal connected to said second current handling terminal of said first transistor and a second terminal;

A second load device having a first terminal connected to said second of said first load device and a second terminal connected to a second reference voltage;

A second differential amplifier having an inverting input terminal, a non-inverting input terminal connected to said first terminal of said second load device and having an output terminal, said output terminal providing voltage detection output signal;

A second transistor having a control terminal connected to said output terminal of said first differential amplifier, having a first current handling terminal connected to said second reference voltage and having a second current handling terminal connected to said inverting input terminal of said second differential amplifier;

A third load device having a first terminal connected to said inverting input terminal of said second differential amplifier and having a second terminal connected to the point at which a voltage level is to be detected.

35. A circuit for detecting voltage levels in an integrated circuit comprising:

A first reference voltage;

A first differential amplifier having an inverting input terminal connected to said first reference voltage, a non-inverting input terminal and an output terminal;

A first transistor having a control terminal connected to said output terminal of said first differential amplifier, having a first current handling terminal connected to a voltage supply terminal and having a second current handling terminal connected to said non-inverting input terminal of said first differential amplifier;

A first load device having a first terminal connected to said second current handling terminal of said first transistor and a second terminal;

A second load device having a first terminal connected to said second of said first load device and a second terminal connected to a second reference potential;

A second differential amplifier having an inverting input terminal, a non-inverting input terminal connected to said first terminal of said second load device and having an output terminal, said output terminal providing voltage detection output signal;

A second transistor having a control terminal, having a first current handling terminal connected to said voltage supply terminal and having a second current handling terminal connected to said inverting input terminal of said second differential amplifier;

A third transistor having a control terminal connected to said output terminal of said first differential amplifier, having a first current handling terminal connected to said voltage supply terminal and having a second current handling terminal;

A fourth transistor having a control terminal connected to said second control terminal of said third transistor and connected to said control terminal of said second transistor, having a first current handling terminal connected to said second control terminal of said third transistor and connected to said control terminal of said second transistor and having a second current handling terminal connected to said second reference voltage; and A third load device having a first terminal connected to said inverting input terminal of said second differential amplifier and having a second terminal connected to the point at which a voltage level is to be detected.

36. A circuit for detecting voltage levels in an integrated circuit comprising:

A first reference voltage;

A first differential amplifier having an inverting input terminal connected to said first reference voltage, a non-inverting input terminal and an output terminal;

A first transistor having a control terminal connected to said output terminal of said first differential amplifier, having a first current handling terminal connected to a voltage supply terminal and having a second current handling terminal connected to said non-inverting input terminal of said first differential amplifier;

A first load device having a first terminal connected to said second current handling terminal of said first transistor and a second terminal;

A second load device having a first terminal connected to said second of said first load device and a second terminal connected to a second reference voltage;

A second differential amplifier having an inverting input terminal, a non-inverting input terminal connected to said first terminal of said second load device and having an output terminal, said output terminal providing voltage detection output signal;

A second transistor having a control terminal, having a first current handling terminal connected to said voltage supply terminal and having a second current handling terminal connected to said inverting input terminal of said second differential amplifier;

A third transistor having a control terminal connected to said output terminal of said first differential amplifier, having a first current handling terminal connected to said voltage supply terminal and having a second current handling terminal;

A fourth transistor having a control terminal connected to said second control terminal of said third transistor and connected to said control terminal of said second transistor, having a first current handling terminal connected to said second control terminal of said third transistor and connected to said control terminal of said second transistor and having a second current handling terminal connected to said second reference voltage; and A third load device having a first terminal connected to said inverting input terminal of said second differential amplifier and having a second terminal connected to the point at which a voltage level is to be detected.

* * * * *

UNITED STATES PATENT AND TRADEMARK OFFICE

CERTIFICATE OF CORRECTION

PATENT NO. : 6,037,762
DATED : March 14, 2000
INVENTOR(S) : Koelling et al.

It is certified that error appears in the above-identified patent and that said Letters Patent is hereby corrected as shown below:

Title page, following: "Inventors"
please insert,-- [60] Provisional Application No. 60/068,176, 12/19/1997--

Signed and Sealed this

Twenty-seventh Day of February, 2001

Attest:

Nicholas P. Godici

NICHOLAS P. GODICI

Attesting Officer

Acting Director of the United States Patent and Trademark Office